US011226161B2

(12) United States Patent
Jo et al.

(10) Patent No.: US 11,226,161 B2
(45) Date of Patent: Jan. 18, 2022

(54) HEAT EXCHANGER

(71) Applicant: Hanon Systems, Daejeon (KR)

(72) Inventors: Wi Sam Jo, Daejeon (KR); Ho Chang Sim, Daejeon (KR); Sun Mi Lee, Daejeon (KR); Hong-Young Lim, Daejeon (KR)

(73) Assignee: Hanon Systems, Daejeon (KR)

( * ) Notice: Subject to any disclaimer, the term of this patent is extended or adjusted under 35 U.S.C. 154(b) by 55 days.

(21) Appl. No.: 16/227,542

(22) Filed: Dec. 20, 2018

(65) Prior Publication Data

US 2019/0195572 A1 Jun. 27, 2019

(30) Foreign Application Priority Data

Dec. 21, 2017 (KR) ..... 10-2017-0176624

(51) Int. Cl.

| | |
|---|---|
| ***F28F 1/12*** | (2006.01) |
| ***F28D 1/053*** | (2006.01) |
| ***F28F 1/02*** | (2006.01) |
| ***F28F 9/02*** | (2006.01) |
| ***F28F 21/08*** | (2006.01) |

(Continued)

(52) U.S. Cl.

CPC ..... *F28F 1/126* (2013.01); *F28D 1/05366* (2013.01); *F28F 1/022* (2013.01); *F28F 1/025* (2013.01); *F28F 1/12* (2013.01); *F28F 1/128* (2013.01); *F28F 9/0243* (2013.01); *F28F 21/084* (2013.01); *F28D 1/06* (2013.01); *F28D 2021/008* (2013.01); *F28D 2021/0084* (2013.01); *F28F 2225/04* (2013.01); *F28F 2255/16* (2013.01)

(58) Field of Classification Search

CPC ..... F28D 1/05366; F28D 2021/0084; F28D 2021/008; F28D 1/05383; F28F 1/126; F28F 1/022; F28F 9/0243; F28F 21/084; F28F 2255/16; F28F 2225/04; F28F 1/10; F28F 2215/10

See application file for complete search history.

(56) References Cited

U.S. PATENT DOCUMENTS 3,596,495 A * 8/1971 Huggins ..... F28D 1/0478 72/370.18
5,251,692 A * 10/1993 Haussmann ..... F28D 1/05383 165/152

(Continued)

FOREIGN PATENT DOCUMENTS

CN 106996711 A 8/2017
EP 3370027 A1 * 9/2018 ..... F28F 21/084

(Continued)

*Primary Examiner* — Ljiljana V. Ciric
(74) *Attorney, Agent, or Firm* — Norton Rose Fulbright US LLP; James R. Crawford

(57) ABSTRACT

A heat exchanger having an optimum design considering a thermal capacity of an end portion of an extrusion tube to significantly improve heat transfer performance by optimizing a shape and a thickness of the end portion of the tube, and a heat exchanger having an optimum design obtained based on a structured rule to enable easy application to other tubes with various dimensions. The heat exchanger has an end portion of a tube has a cross section in a quadrangular shape with rounded corners, each having a radius in a range of 15% to 45% of a height of the tube.

15 Claims, 9 Drawing Sheets

(51) Int. Cl.
*F28D 21/00* (2006.01)
*F28D 1/06* (2006.01)

(56) References Cited

U.S. PATENT DOCUMENTS 5,458,190 A * 10/1995 Sasaki ..... B21C 37/22 165/110
RE35,655 E * 11/1997 Hoshino ..... B21C 37/22 165/110
7,165,606 B2 * 1/2007 Take ..... F25B 39/00 165/175
2007/0071920 A1 * 3/2007 Muto ..... F28D 1/05383 428/34.4
2010/0115771 A1 * 5/2010 Johnson ..... F28F 1/022 29/890.052
2010/0186936 A1 * 7/2010 Nishikawa ..... F28D 1/05391 165/173
2011/0284195 A1 * 11/2011 Chowdhury ..... F28F 1/022 165/174
2012/0031586 A1 * 2/2012 Sugimura ..... F25B 39/04 165/104.21
2012/0267086 A1 * 10/2012 Yanik ..... F25B 39/00 165/174
2013/0043014 A1 * 2/2013 Nakado ..... F28F 1/022 165/181
2015/0060035 A1 * 3/2015 Furumura ..... B23K 35/362 165/180
2016/0327346 A1 * 11/2016 Dziubinschi ..... B21C 23/085
2017/0211892 A1 * 7/2017 Lim ..... F28F 1/04
2018/0164052 A1 * 6/2018 Nakamura ..... B21C 23/085
2019/0195564 A1 * 6/2019 Lim ..... F28D 1/05383
2020/0047290 A1 * 2/2020 Katsumata ..... B23K 35/3605
2020/0116444 A1 * 4/2020 Shinoda ..... B23K 1/0012
2021/0113938 A1 * 4/2021 Wan ..... B01D 5/0015
2021/0140720 A1 * 5/2021 Kent ..... F28F 1/022

FOREIGN PATENT DOCUMENTS

JP 2007093144 A 4/2007
WO WO-2005091968 A2 * 10/2005 ..... F28D 1/05375

* cited by examiner (A)

(B)

HEAT EXCHANGER

CROSS-REFERENCE TO RELATED APPLICATIONS

This application claims priority under 35 U.S.C. § 119 to Korean Patent Application No. 10-2017-0176624, filed on Dec. 21, 2017, in the Korean Intellectual Property Office, the disclosure of which is incorporated herein by reference in its entirety.

TECHNICAL FIELD

The following disclosure relates to a heat exchanger, and more particularly, to a heat exchanger tube which is a tube included in a heat exchanger operated under a high-pressure environment, the heat exchanger tube being formed by an extrusion method and having optimized heat transfer performance.

BACKGROUND

A heat exchanger is an apparatus for exchanging heat between surrounding environments such as a working fluid, external air, other fluids, or the like. A commonly and widely used heat exchanger includes a tube including a channel through which a working fluid passes and a tube wall for heat transfer to an external medium (fins, or the like). In the heat exchanger, generally, a plurality of tubes are arranged in parallel, and fins for improving heat transfer performance are provided while being interposed between the tubes.

The heat exchanger tube generally has a flat pipe form and the fin is brazed on an outer side of a flat surface of the tube. Such a heat exchanger tube may be formed by various methods. For example, a method of bending a thin metal plate and bonding end portions of the metal plate to each other, or the like has also been widely used. However, when a working fluid flows at high pressure in the heat exchanger tube, the tube formed by the method as described above may have a problem in that the tube is damaged as stress is concentrated on a bonding portion, thereby resulting in leakage of the working fluid, or the like. Therefore, a tube formed by an extrusion method so that a bonding portion is not generated has been generally used in a high-pressure heat exchanger.

It is easy for the tube formed by the extrusion method (hereinafter, referred to as an extrusion tube) to have a complicated cross-sectional shape, than for the tube manufactured by the plate bonding method. Accordingly, a design for the extrusion tube, in which a plurality of partition walls (hereinafter, referred to internal walls) are formed in a channel (that is, a space inside the tube), has been introduced in many cases in order to further improve heat transfer performance in the channel in the tube. By doing so, an area of wall surfaces in the tube contacting a working fluid (refrigerant) becomes large, such that an amount of heat transferred to the tube from the working fluid is increased. As a result, heat transfer performance may be improved.

Meanwhile, a heat exchanger provided in a vehicle generally has a design that a surface exposed to the outside has higher rigidity in order to secure sufficient durability against external impacts caused by a collision with a stone flicked up from a road, or the like. The heat exchanger tube is generally manufactured to have a flat shape and a plurality of heat exchanger tubes are arranged in parallel in a form in which the plurality of heat exchanger tubes are stacked so that flat surfaces face one another. Therefore, a surface exposed to the outside is an end portion of one side or end portions of both sides of the flat surface. In particular, it is easy for the tube manufactured by the extrusion method to have a complicated cross-sectional shape as described above. Therefore, in this case, a thickness of an outer wall of the end portion of the tube is larger than those of other portions of the tube. Generally, such a cross-sectional shape of the end portion of the tube is a nearly semicircular shape. Japanese Patent Laid-Open Publication No. 2007-093144 (published on Apr. 12, 2007 and entitled "Heat Exchanging Tube and Heat Exchanger") discloses an extrusion tube of which a thickness of an outer wall of an end portion of one side is larger than those of other portions of the extrusion tube, which is designed for the object as described above.

A shape of the end portion of the tube determines a bonding length of a fin and the tube, and the bonding length of the fin and the tube is in proportion to a heat transfer area between the tube and the fin. That is, the bonding length of the fin and the tube directly affects heat transfer performance from the tube to the fin, Meanwhile, a thermal capacity of the tube is in proportion to a weight of the tube, and the larger the weight is, the larger the quantity of heat transferred from a working fluid is, such that heat transfer performance is improved. The end portion of the tube most largely affects the thermal capacity of the tube, the end portion first contacting an external medium, that is, air, to which heat is finally transferred.

However, in the related art, the thermal capacity, the heat transfer area, and the like have not been considered in designing a shape of the end portion of the tube, but only convenience in manufacturing has been considered or the existing shape has been used without knowing that the existing shape needs to be upgraded. Therefore, a new optimum design considering a relationship between a shape of the end portion of the tube and a thermal capacity, and the like as described above is required.

RELATED ART DOCUMENT

Patent Document

Japanese Patent Laid-Open Publication No. 2007-093144 (published on Apr. 12, 2007 and entitled "Heat Exchanging Tube and Heat Exchanger").

SUMMARY

An embodiment of the present invention is directed to providing a heat exchanger having an optimum design considering a thermal capacity of an end portion of an extrusion tube to maximize heat transfer performance by optimizing a shape and a thickness of the end portion of the tube. Another embodiment of the present invention is directed to providing a heat exchanger having an optimum design based on a structured rule to enable easy application to other tubes with various dimensions.

In one general aspect, a heat exchanger includes: a pair of header tanks 110 spaced apart from each other by a predetermined distance and disposed in parallel with each other; a plurality of tubes 120 having both ends fixed to the pair of header tanks 110 to form channels for a refrigerant; and fins 130 interposed between the tubes 120, wherein the tube 120 is an extrusion tube, a width W of the tube is larger than a height H of the tube, and when the channel in the tube 120 is partitioned into a plurality of holes 122 disposed in parallel with each other in a width direction of the tube 120 by a plurality of internal walls 121 extending in a height direction of the tube 120, the heat exchanger has dimensions within a range in which a position X in the width direction from an end portion of the tube 120 and a cross-sectional area A of the tube 120 in a length direction at the position X in the width direction satisfy the following Expressions so that a cross section of the end portion of the tube 120 has a quadrangular shape of which corners are rounded or a larger shape than the quadrangular shape of which corners are rounded.

$$A \leq HL \text{ wherein } 0 < X \leq w0 \qquad \text{Expression 1}$$

$$A \geq HL + 2rL(\sqrt{(1-(X/r-1)^2-1)} \cdot X, \text{ wherein } 0 < X \leq r \text{ and } 0.15H < r < 0.45H \qquad \text{Expression 2}$$

(Here, X is a position in the width direction, A is a cross-sectional area in the length direction, H is a height of the tube, r is a radius of the rounded corner of the tube, L is a length of the tube, w0 is a thickness of the outer wall in the width direction of the end portion in the width direction of the tube, and we is a value of X at the tube-fin contact point.)

The heat exchanger 100 may have dimensions within a range in which the following Expression is satisfied so that a position where the tube 120 contacts the fin 130 is located in front of a position of a first hole 122 of the tube 120.

$$wc \leq w0 \qquad \text{Expression 3:}$$

(Here, w0 is a thickness of the outer wall in the width direction of the end portion in the width direction of the tube, and wc is a value of X at the tube-fin contact point.)

When an expression expressing a range of positions of first holes to n0-th holes from the opposite end portions with the position X in the width direction is an end portion range expression, the end portion range expression is as follows.

First hole: $w0 \leq X \leq w0 + h0$ $n0$-$th$ hole: $(w0+h0)+((n0-1)w+(n0-2)h) \leq X \leq (w0+h0)+(n0-1)(w+h)$ $N-n0+1$-$th$ hole: $(w0+h0)+((N-n0)w+(N-n0-1)h) \leq X \leq (w0+h0)+(N-n0)(w+h)$ $N$-$th$ hole: $(w0+h0)+((N-1)w+(N-2)h) \leq X \leq (w0+2h0)+((N-1)w+(N-2)h)$ (Here, n is a hole index, N is a total number of holes, h0 is a width of a hole of the end portion of the tube in the width direction, and h is a width of a hole at the remaining positions.)

When an expression expressing a range of positions of the holes 122 corresponding to the remaining region other than a region corresponding to the range of the end portion range expression with the position X in the width direction is an intermediate portion range expression, the intermediate portion range expression is as follows.

$n$-$th$ hole: $(w0+h0)+((n-1)w+(n-2)h) \leq X \leq (w0+h0)+(n-1)(w+h), n0 < n < N-n0+1$ (Here, n is a hole index, N is a total number of holes, h0 is a width of a hole of the end portion of the tube in the width direction, and h is a width of a hole at the remaining positions.)

The heat exchanger 100 may have dimensions within a range in which the position X in the width direction and a thickness t of an outer wall in the height direction at a position of a hole 122 satisfy the following Expression so that a thickness t of an outer wall in the height direction at a position of a hole 122 in the range of the end portion range expression is t0.

t=t0 (when X is within the range of the end portion range expression)

(Here, t0 is a thickness of an outer wall in the height direction at a position of a hole of the end portion side of the tube in the width direction.)

The heat exchanger 100 may have dimensions within a range in which the position X in the width direction and a thickness t of an outer wall in the height direction at a position of a hole 122 satisfy the above Expression so that tm is a thickness t of an outer wall in the height direction at a position of a hole 122 in the range of the intermediate portion range expression, and a thickness t of an outer wall in the height direction at a position of a hole 122 in the range of the end portion range expression is larger than a thickness t of an outer wall in the height direction at a position of a hole 122 in the range of the intermediate portion range expression.

t=tm (when X is within the range of the intermediate portion range expression)

$$t0 > tm \qquad \text{Expression 4:}$$

(Here, t0 is a thickness of an outer wall in the height direction at a position of a hole of the end portion side of the tube in the width direction, and tm is a thickness of an outer wall in the height direction at a position of a hole of the intermediate portion side of the tube in the width direction.)

The heat exchanger 100 may have dimensions within a range in which the following Expression is satisfied so that the range of the end portion range expression is a range of positions of first holes to second holes or third holes from the opposite end portions.

$$2 \leq n0 \leq 3$$

10% to 20% of a total weight of the tube 120 may be biasedly distributed to a region corresponding to the following range of the position X in the width direction so that the weight is biasedly distributed to a region corresponding to a range of positions of first holes to second holes or third holes from the opposite end portions.

First hole: $w0 \leq X \leq w0 + h0$ $n0$-$th$ hole: $(w0+h0)+((n0-1)w+(n0-2)h) \leq X \leq (w0+h0)+(n0-1)(w+h)$ $N-n0+1$-$th$ hole: $(w0+h0)+((N-n0)w+(N-n0-1)h) \leq X \leq (w0+h0)+(N-n0)(w+h)$ $N$-$th$ hole: $(w0+h0)+((N-1)w+(N-2)h) \leq X \leq (w0+2h0)+((N-1)w+(N-2)h)$ $$2 \leq n0 \leq 3 \qquad \text{Expression 5:}$$

(Here, n is a hole index, N is a total number of holes, h0 is a width of a hole of the end portion of the tube in the width direction, and h is a width of a hole at the remaining positions.)

The tube 120 may be formed of an aluminum material.

Other features and aspects will be apparent from the following detailed description, the drawings, and the claims.

| [Detailed Description of Main Elements] | |
|---|---|
| 100: Heat exchanger | |
| 110: Header tank | 120: Tube |
| 130: Fin | 135: louver |

DETAILED DESCRIPTION OF EMBODIMENTS

Hereinafter, a heat exchanger according to an exemplary embodiment of the present invention having a configuration as described above will be described in detail with reference to the accompanying drawings.

Figure 1:
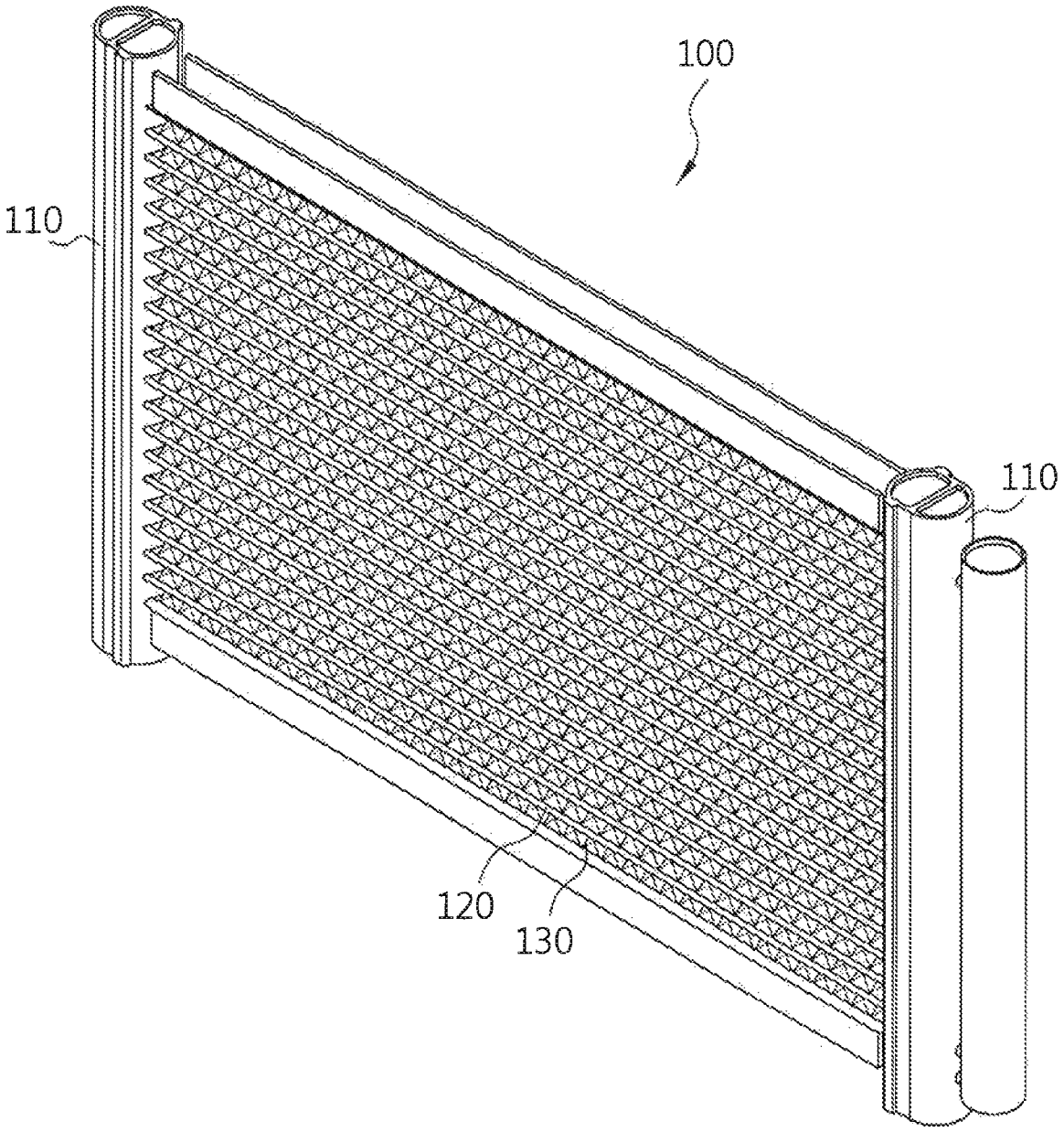
FIG. 1 is a perspective view of a general fin-tube heat exchanger.
Figure 2:
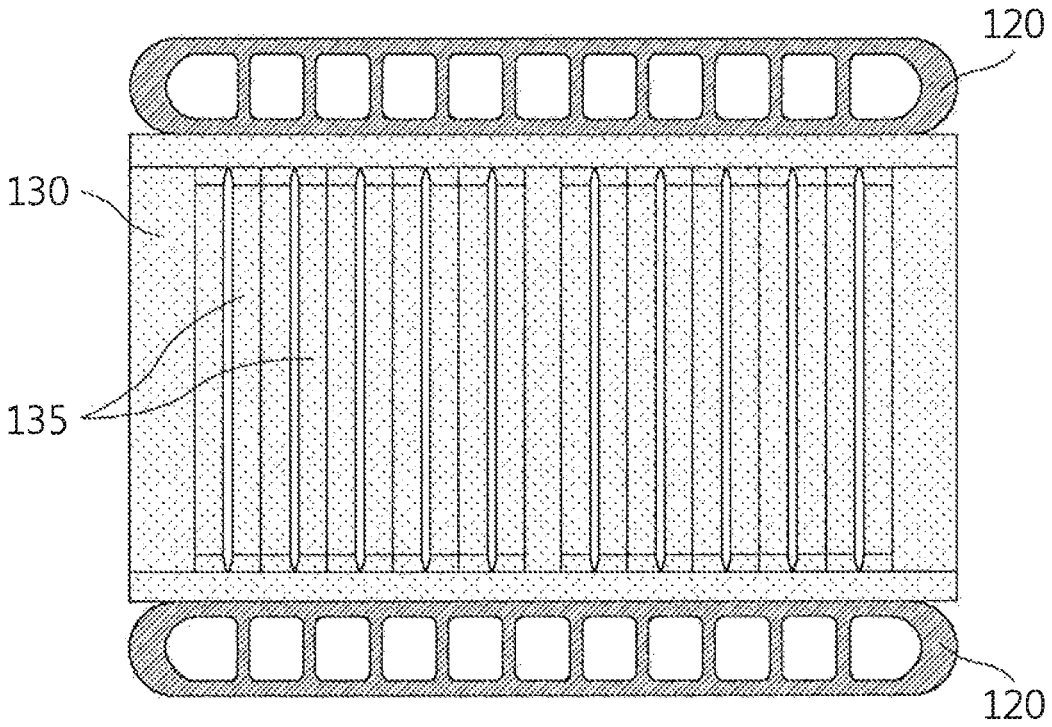
FIG. 2 is a cross-sectional view of an extrusion tube and a louver-fin coupled body according to the related art.

FIG. 1 is a perspective view of a general fin-tube heat exchanger. As illustrated in FIG. 1, a general fin-tube type heat exchanger 100 includes a pair of header tanks 110 spaced apart from each other by a predetermined distance and disposed in parallel with each other, a plurality of tubes 120 having both ends fixed to the pair of header tanks 110 to form channels for a refrigerant, and fins 130 interposed between the tubes 120. In this case, the tube 120 is an extrusion tube formed by an extrusion method, and thus has no joint. Further, a plurality of louvers 135 may be formed on the fin 130, and FIG. 2 is a cross-sectional view of an extrusion tube and a louver-fin coupled body according to the related art. In addition, it is preferable that the heat exchanger 100 is a condenser and the tube 120 is formed of an aluminum material.

The present invention suggests an optimum design based on a structured rule of shapes and dimensions of respective portions of the tube 120, thereby maximizing heat transfer performance from the tube to air.

Figure 3:
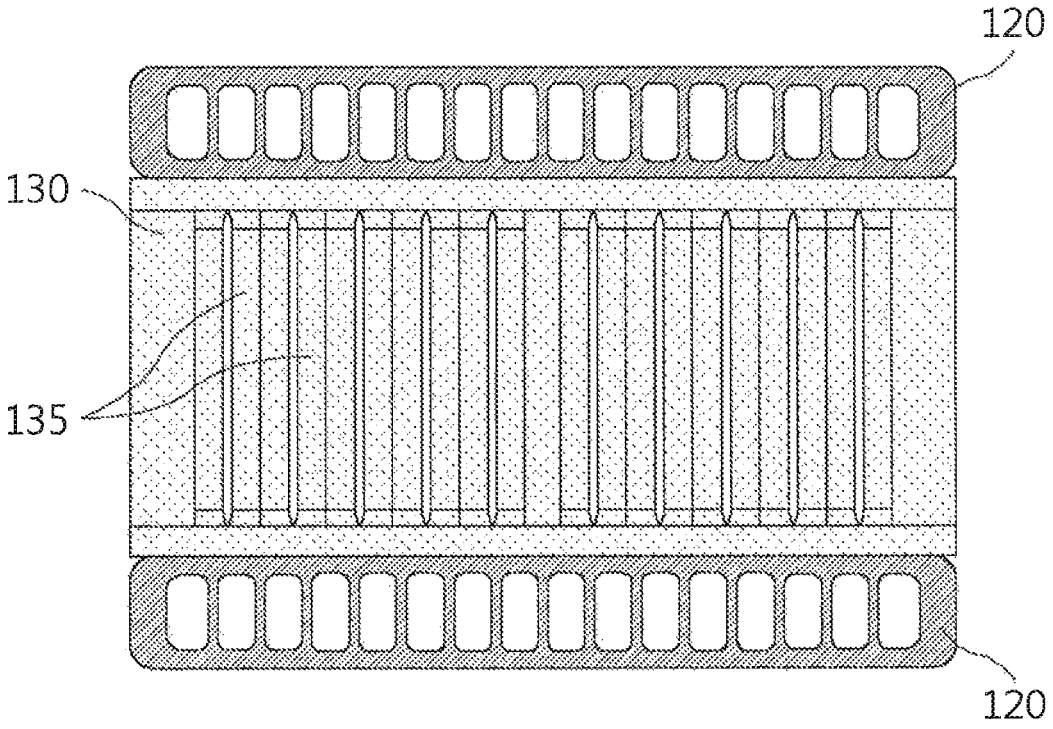
FIG. 3 is a cross-sectional view of an extrusion tube and a louver-fin coupled body according to the present invention.

FIG. 3 is a cross-sectional view of the extrusion tube and a louver-fin coupled body according to the present invention, and it may be intuitively appreciated that a shape of an end portion of the extrusion tube according to the present invention is different from that of the extrusion tube according to the related art illustrated in FIG. 2. For more detailed description, respective portions of the extrusion tube according to the related art and the extrusion tube according to the present invention will defined with reference to FIGS. 4A and 4B.

Figure 4A:
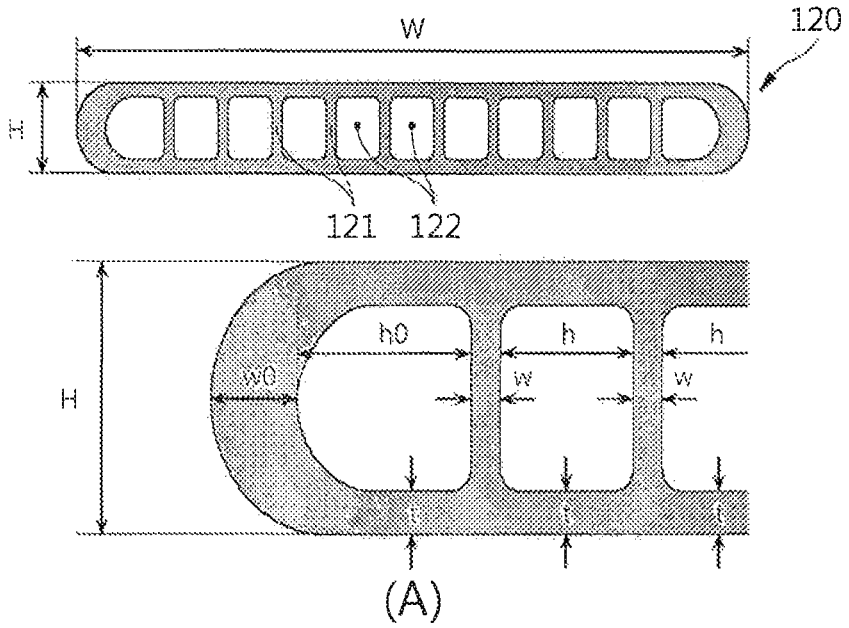
FIGS. 4A and 4B illustrate definition of respective portions of the extrusion tube according to the related art and the extrusion tube according to the present invention, respectively.
Figure 4B:
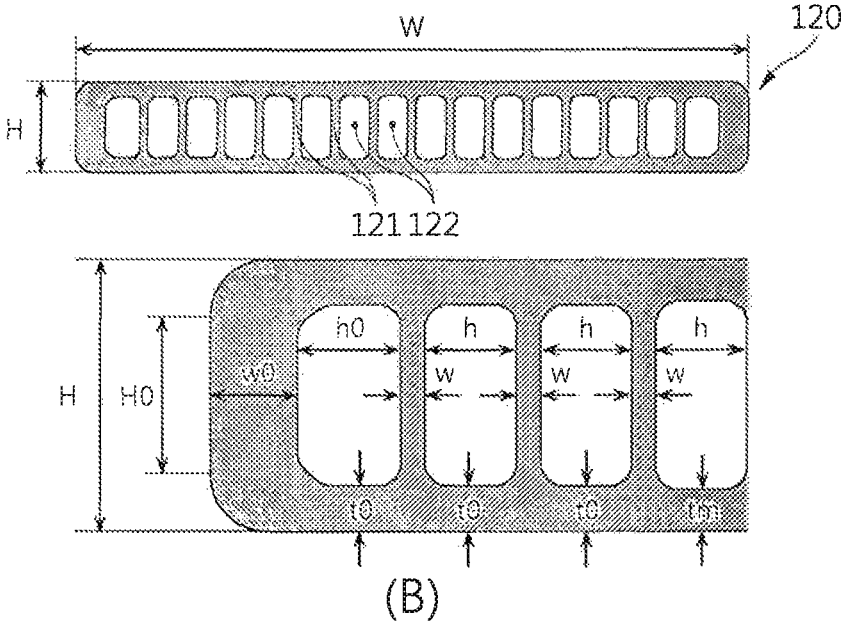

As illustrated in FIGS. 4A and 4B, it is assumed that a width W of the tube, and a height H of the tube according to the related art are the same as those according to the present invention. Similarly to the tube according to the related art, in the tube 120 according to the present invention, a width W of the tube is basically larger than the height H of the tube, and the channel in the tube 120 is partitioned into a plurality of holes 122 disposed in parallel with each other in a width direction of the tube 120 by a plurality of internal walls 121 extending in a height direction of the tube 120, as illustrated in FIG. 4B.

Figure 5A:
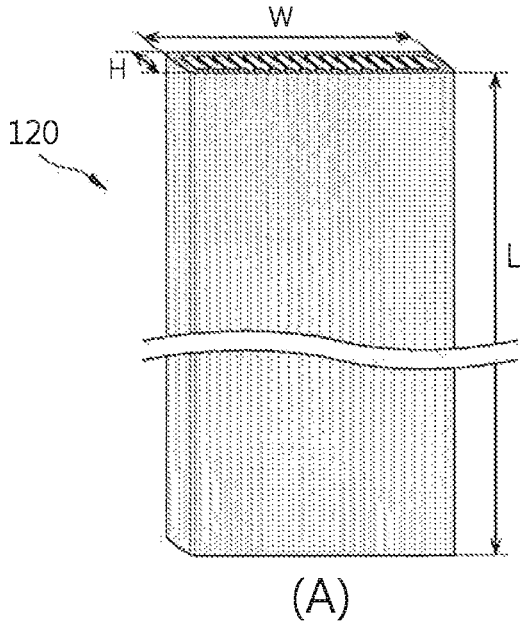
FIGS. 5A to 5E are views for describing positions from an end portion of the tube in a width direction and cross-sectional areas in a length direction at the respective positions.
Figure 5B:
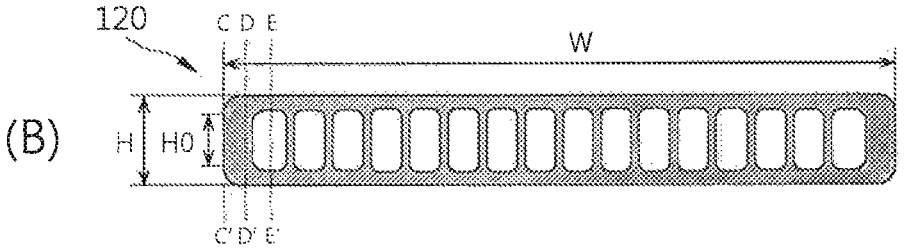
Figure 5C:
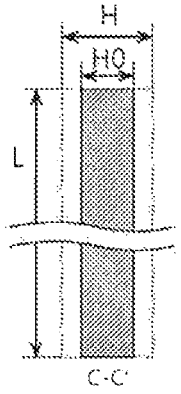
Figure 5D:
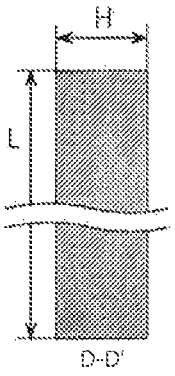
Figure 5E:
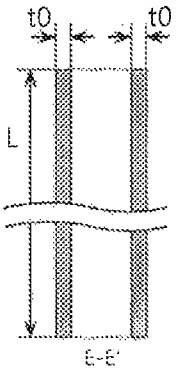
Figure 6A:
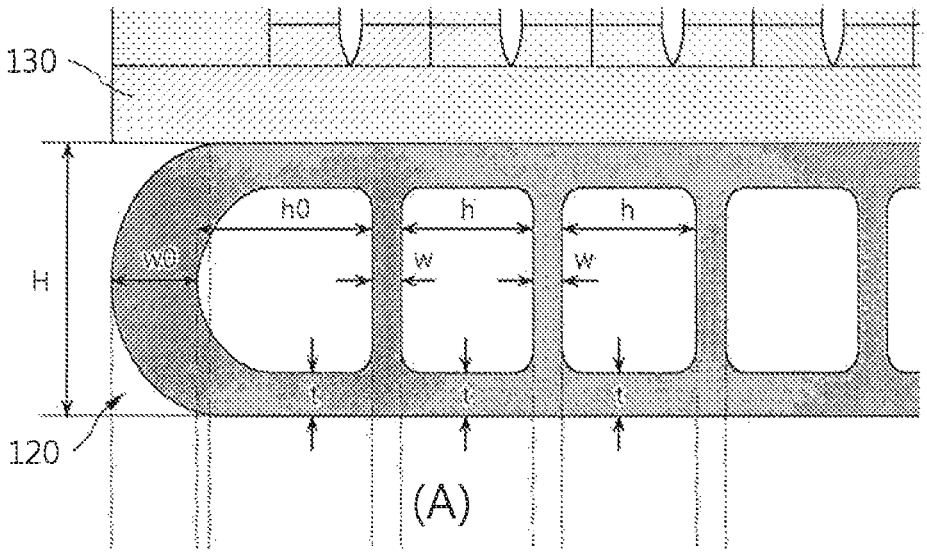
FIGS. 6A and 6B are a partial cross-sectional view of the tube according to the related art and a graph of a relationship between positions from an end portion of the tube according to the related art in a width direction and cross-sectional areas in a length direction at the respective positions.
Figure 6B:
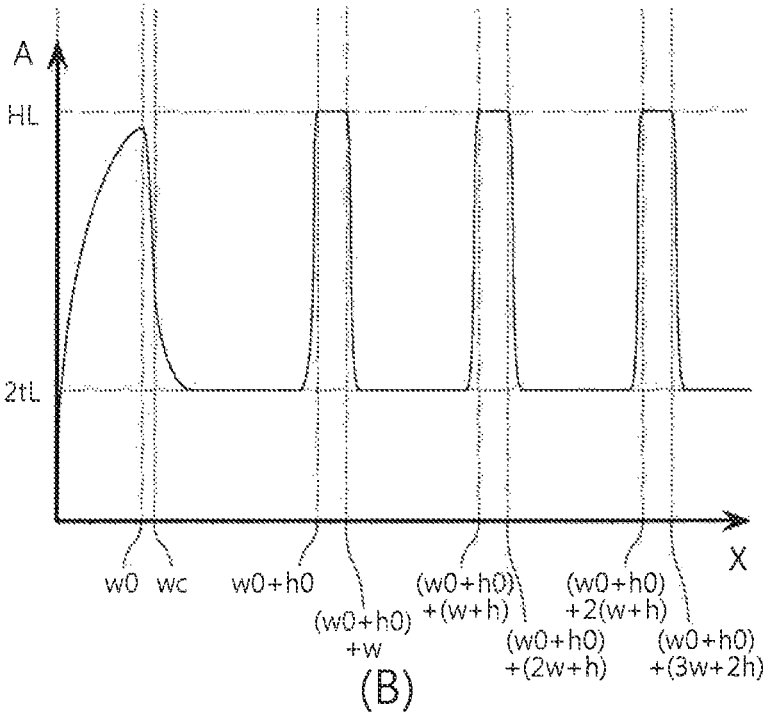

FIGS. 5A to 5E are a perspective view of the tube 120 and views for describing positions from an end portion of the tube in a width direction and cross-sectional areas in a length direction at the respective positions. As illustrated in FIG. 5A, the tube 120 has a cross section of which the width w of the tube is larger than the height H of the tube, and the cross section extends to a length L of the tube in the length direction, such that the tube 120 is formed in a flat and long shape. The cross-sectional view of FIG. 5B is the same as that of FIG. 4B and illustrates the cross section of the tube 120 according to the present invention. In this case, a position from the end portion of the tube in the width direction is X as indicated in FIG. 6B.

When X=0, the position is the outermost end of the tube 120. Here, a shape of a cross section taken along line C-C' in the length direction in FIG. 5B is as shown in FIG. 5C and a cross-sectional area A in the length direction in this case is obtained by multiplying a height H0 of the tube at the outermost end of the tube 120 by the length L of the tube.

Xc indicates a position where the tube 120 first contacts the fin 130. Therefore, when X=Xc, a shape of a cross section taken along line D-D' in the length direction in FIG. 5B is as shown in FIG. 5D and a cross-sectional area A in the length direction in this case is obtained by multiplying the height H of the tube by the length L of the tube.

Meanwhile, line E-E' indicates a case in which the position X is on the hole 122 of the tube 120. Here, a shape of a cross section taken along line E-E' in the length direction in FIG. 5B is as shown in FIG. 5E and a cross-sectional area A in the length direction in this case is obtained by multiplying a value (2t0) corresponding to two times the thickness t0 of an outer wall at the position on the hole in the height direction by the length L of the tube. In FIG. 5E, the position X is on the hole at the end portion of the tube in the width direction, the thickness of the outer wall thus is t0. However, in the case in which the thickness of the outer wall is changed at other positions, a cross-sectional area A in the length direction in this case is obtained by multiplying a value corresponding to two times the thickness of the outer wall at the corresponding position by the length L of the tube.

Figure 7A:
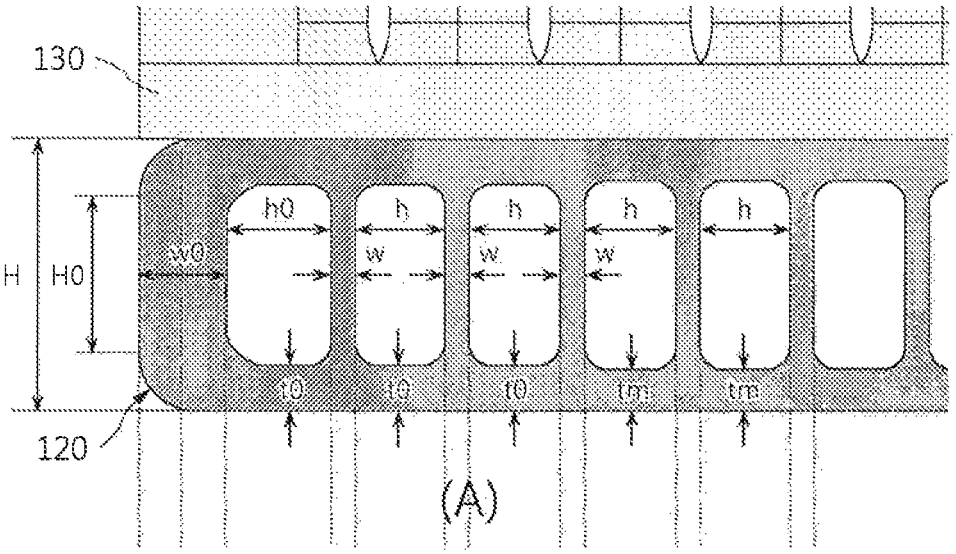
FIGS. 7A and 7B are a partial cross-sectional view of the tube according to the present invention and a graph of a relationship between positions from an end portion of the tube according to the present invention in a width direction and cross-sectional areas in a length direction at the respective positions.

As described above, in designing a shape of the end portion of the tube according to the present invention, a contact length between the tube and the fin is maximized to increase a heat transfer area, and a weight is biasedly distributed to the end portions of the tube to increase a thermal capacity of the end portion of the tube first contacting air. According to the related art, a shape of the cross section of the end portion of the tube is a semicircular shape as illustrated in FIGS. 4A and 6A. Therefore, a position where the tube first contacts the fin is substantially apart from the end portion of the tube and besides, a thermal capacity of the end portion of the tube is not sufficiently high. However, according to the present invention, a shape of the cross section of the end portion of the tube is a quadrangular shape of which corners are rounded as illustrated in FIGS. 4B and 7A. Therefore, a position where the tube first contacts the fin is much closer to the end portion of the tube, and a weight biasedly distributed to the end portions of the tube is largely increased, resulting in improvement of a thermal capacity of the end portion of the tube. A detailed description thereof will be provided below.

Condition for Securing Thermal Capacity of End Portion of Tube: Cross-Sectional Area in Length Direction FIGS. 6A and 6B are a partial cross-sectional view of the extrusion tube according to the related art and a graph of a relationship between positions from an end portion of the extrusion tube according to the related art in a width direction and cross-sectional areas in a length direction at the respective positions, and FIGS. 7A and 7B are a partial cross-sectional view of the extrusion tube according to the present invention and a graph of a relationship between positions from an end portion of the extrusion tube according to the present invention in a width direction and cross-sectional areas in a length direction at the respective positions.

Referring to FIGS. 6A and 6B, a shape of the cross section of the end portion of the tube according to the related art is a semicircular shape, therefore, when the position X in the width direction is 0, the cross-sectional area A in the length direction is 0. When the position X in the width direction is gradually increased from 0, the cross-sectional area A in the length direction which is a value obtained by multiplying a current height of the cross section of the end portion of the tube at the corresponding position by the length L of the tube, is gradually increased accordingly. However, since the position X in the width direction reaches the hole 122 before reaching a point where the tube 120 contacts the fin 130, a maximum value of the cross-sectional area A in the length direction may not reach HL. Then, when the position X in the width direction is a position on the hole 122, the cross-sectional area A in the length direction is obtained by multiplying a value (2t) corresponding to two times the thickness t of the outer wall in the height direction at the position of the hole 122 by the length L of the tube, that is, the cross-sectional area A in the length direction is 2tL. When the position X in the width direction is a position of the internal wall 121, the cross-sectional area A in the length direction is obtained by multiplying the height H of the tube by the length L of the tube, that is, the cross-sectional area A in the length direction is HL.

An integral value (that is, an area of a portion under the graph illustrated in FIG. 6B) of the cross-sectional area A in the length direction with respect to the position X in the width direction is a volume, and the volume is in proportion to the weight. That is, as the integral value of the cross-sectional area A in the length direction is increased, the weight of the end portion of the tube is increased and ultimately a thermal capacity is increased, thereby improving heat transfer performance. In the present invention, a shape of the end portion of the tube is designed as follows based on the technical object as described above.

Figure 7B:
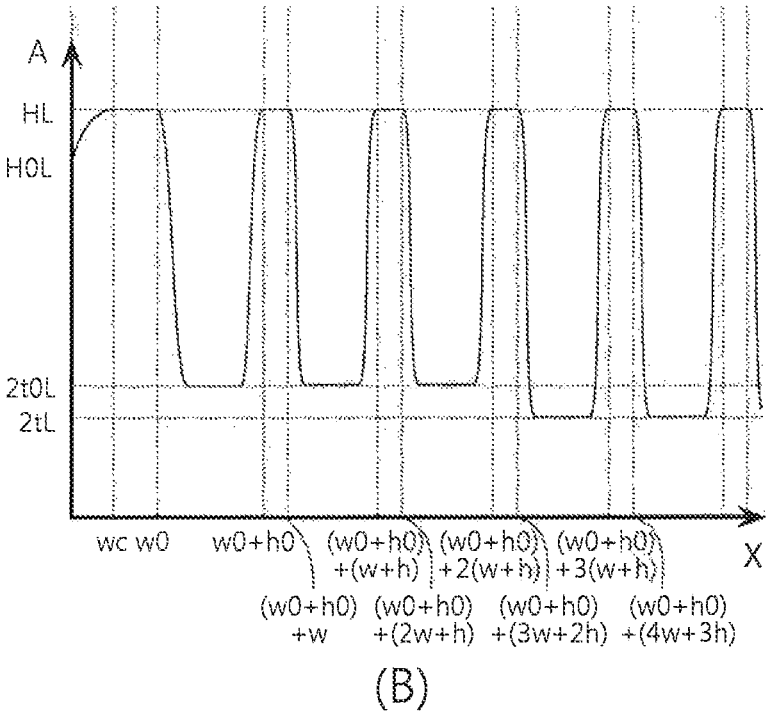

Referring to FIGS. 7A and 7B, a shape of the cross section of the end portion of the tube according to the present invention is a quadrangular shape of which corners are rounded, therefore, even when the position X in the width direction is 0, the cross-sectional area A in the length direction also has a certain value. As illustrated in FIGS. 4B and 7B, the cross-sectional area A in the length direction is H0L in which H0 is a height of the tube at the position X in the width direction of 0. When the position X in the width direction is gradually increased from 0 and reaches the point where the tube 120 contacts the fin 130, the cross-sectional area A in the length direction has a maximum value of HL, and the maximum value is maintained until the position X in the width direction is further increased and reaches the hole 122. In the case of the tube according to the related art as described above, when X is 0 (X=0), A is 0 (A=0), and since X reaches the hole before reaching a point where the tube contacts the fin (hereinafter, referred to as a tube-fin contact point), the maximum value of A may not reach HL. On the contrary, in the case of the tube according to the present invention, when X is 0 (X=0), A is H0L (A=H0L), and since X reaches the tube-fin contact point before reaching the hole, a state in which the maximum value of A is HL may be maintained for a substantially long period of time.

That is, in the present invention, the end portion of the tube 120 has a shape in which the tube-fin contact point is moved further forward in comparison to that in the related art, unlike the semicircular shape according to the related art, and a graph of the cross-sectional area A in the length direction with respect to the position X in the width direction is located above the graph in the related art (that is, an area of a portion under the graph of the cross-sectional area A in the length direction is larger than the area in the related art). As a result, the weight of the end portion of the tube is increased and a thermal capacity is increased, thereby ultimately largely improving heat transfer performance in comparison to the related art.

Figure 8A:
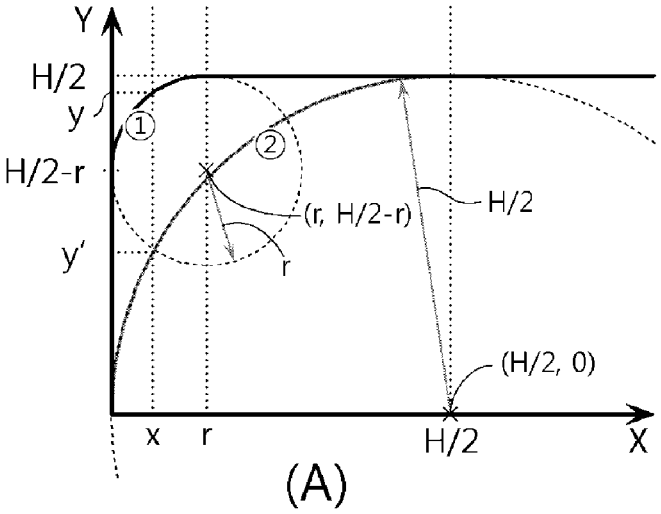
FIGS. 8A and 8B are graphs for comparing a relationship between normalized positions from an end portion of the tube according to the present invention in a width direction and cross-sectional areas in a length direction at the respective positions.

The shape of the end portion of the tube 120 according to the present invention will be described in more detail as below. As described above, in the present invention, the shape of the cross section of the end portion of the tube is a quadrangular shape of which corners are rounded (see FIGS. 4B and 7A). When a radius of the rounded corner is r, and a position based on the central point of the tube 120 in the height direction in the height direction is Y, the shape of the end portion of the tube 120 may be represented by the following Expression by using the position X in the width direction and the position Y in the height direction. The following Expression represents a circle of which the center is (r, H/2−r) and a radius is r as illustrated in FIG. 8A. A portion satisfying 0<X<r and Y>0 in the graph based on the following Expression corresponds to the shape of the end portion of the tube 120 with the central point of the tube 120 in the height direction as the origin.

$$(X-r)^2+(Y-(H/2-r))^2=r^2$$

In this case, the shape of the end portion of the tube according to the related art, that is, the semicircular shape of the end portion of the tube may be represented by the following Expression. The following Expression represents a circle of which the center is (H/2, 0) and a radius is H/2 as illustrated in FIG. 8A. A portion satisfying 0<X<H/2 and Y>0 in the graph based on the following Expression corresponds to the shape of the end portion of the tube 120 according to the related art.

$$(X-H/2)^2+Y^2=(H/2)^2$$

Figure 8B:
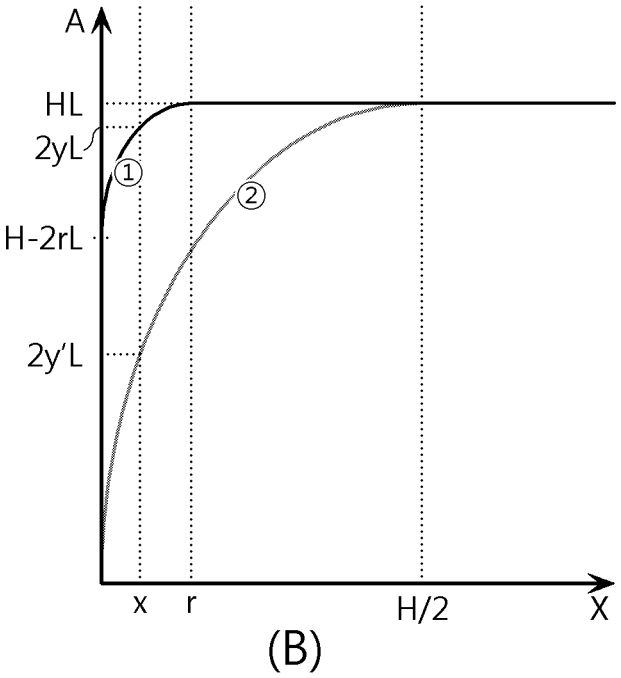

In FIG. 8A, a graph showing the shape of the end portion of the tube 120 according to the present invention is represented by graph ①, and a graph showing the shape of the end portion of the tube according to the related art is represented by graph ②. In the case in which values of the respective graphs ① and ② are, respectively, y and y' when X is any value x, widths of the tube at these points are, respectively, 2y and 2y', and cross-sectional areas A in the length direction are, respectively, 2yL and 2yL'. That is, the cross-sectional area in the length direction may be shown by a graph as illustrated in FIG. 8B which has the same form as the graph of FIG. 8A except for a scale. As described above, an integral value (that is, an area of a portion under the graph) of the cross-sectional area A in the length direction with respect to the position X in the width direction is a volume, and the volume is in proportion to the weight. As can be intuitively appreciated from FIG. 8B, in the case of the shape of the end portion of the tube 120 according to the present invention, the weight may be much more effectively biasedly distributed to the end portions of the tube, in comparison to the case of the shape (semicircular shape) of the end portion of the tube according to the related art.

When the position Y in the height direction is expressed by an Expression for the graph ①, is doubled and then is multiplied by the length L of the tube (that is, 2YL), a relational expression of the position X in the width direction and the cross-sectional area A in the length direction may be as follows.

$$A=HL+2rL(\sqrt{(1-(X/r-1)^2}-1)$$

In this case, an extent of the biased distribution of the weight to the end portions of the tube is changed depending on a change of r. As r is decreased, heat transfer performance from the tube to air is improved (since the extent of the biased distribution of the weight to the end portions of the tube is increased), but manufacturability may deteriorate (since the corner of the tube becomes sharp). On the contrary, as r is increased, manufacturability may be improved (since the corner of the tube becomes round), but an effect of improving heat transfer performance from the tube to air is reduced (since the extent of the biased distribution of the weight to the end portions of the tube is decreased). Therefore, in the present invention, r has a value corresponding to 15% to 45% of the height H of the tube in appropriate consideration of the manufacturability and the effect of improving the heat transfer performance.

As described above, a condition for securing a thermal capacity of the end portion of the tube may be summarized as below in terms of the cross-sectional area in the length direction.

First, in theory, it is most preferable that the shape of the cross section of the end portion of the tube 120 is a complete quadrangular shape in order to maximally secure the thermal capacity by using the shape of the end portion of the tube 120. However, in this case, the cross-sectional area A of the tube 120 in the length direction is HL in a full range of the position X in the width direction. However, in practice, the tube 120 of which the cross section of the end portion has a complete quadrangular shape may not be manufactured due to problems such as manufacturability, and when X is close to 0, A is inevitably smaller than HL. That is, when the position X in the width direction is between a position (X=0) of the end portion of the tube and a position of a first hole (X=w0), the cross-sectional area A of the tube 120 in the length direction may be expressed by the following Expression 1.

$$A\leq HL(0<X\leq w0) \qquad \text{Expression 1:}$$

(Here, X is a position in the width direction, A is a cross-sectional area in the length direction, H is a height of the tube, L is a length of the tube, and w0 is a thickness of the outer wall in the width direction of the end portion of the tube in the width direction.)

Next, according to the description above, it is preferable that the shape of the cross section of the end portion of the tube 120 is a quadrangular shape of which corners are rounded in the present invention. The relational expression of X and A based on FIGS. 8A and 8B represents a case in which the shape of the end portion of the tube 120 is a quadrangular shape of which corners are rounded with a radius r. In the tube 120 according to the present invention, it is preferable that a cross section of the end portion has a quadrangular shape which is smaller than a complete quadrangular shape represented by Expression 1, but is the same as or larger than a quadrangular shape of which corners are rounded. That is, when the position X in the width direction is between a position (X=0) of the end portion of the tube and a corner radius position (X=r), the cross-sectional area A of the tube 120 in the length direction may be expressed by the following Expression 2.

$$A\geq HL+2rL(\sqrt{(1-(X/r-1)^2}-1)(0<X\leq r),\quad 0.15H<r<0.45H \qquad \text{Expression 2:}$$

(Here, X is a position in the width direction, A is a cross-sectional area in the length direction, H is a height of the tube, r is a radius of the rounded corner of the tube, and L is a length of the tube.)

In addition, according to the description above, it is preferable that the tube-fin contact point is moved further forward in comparison to that in the related art so that the position X in the width direction reaches the tube-fin contact point before reaching the position of the first hole, in order to more effectively perform heat transfer from the tube to the fin (at this point in time when the thermal capacity of the end portion of the tube 120 is secured through the shape design as described above). Describing this with the position X in the width direction, X=wc at the tube-fin contact point, and X=w0 at the position of the first hole. That is, the tube 120 may satisfy the following Expression 3 such that the tube contacts the fin at a point located in front of the position of the first hole.

$$wc\leq w0 \qquad \text{Expression 3:}$$

(Here, w0 is a thickness of the outer wall in the width direction of the end portion of the tube in the width direction, and wc is a value of X at the tube-fin contact point.)

In summary, the heat exchanger 100 according to the present invention may have dimensions within a range in which the position X in the width direction from the end portion of the tube 120 and the cross-sectional area A of the tube 120 in the length direction at the position X in the width direction satisfy the following Expressions.

$$A\leq HL(0<X\leq w0) \qquad \text{Expression 1:}$$

$$A\geq HL+2rL(\sqrt{(1-(X/r-1)^2}-1)(0<X\leq r),\quad 0.15H<r<0.45H \qquad \text{Expression 2:}$$

$$wc\leq w0 \qquad \text{Expression 3:}$$

(Here, X is a position in the width direction, A is a cross-sectional area in the length direction, H is a height of the tube, r is a radius of the rounded corner of the tube, L is a length of the tube, w0 is a thickness of the outer wall in the width direction of the end portion of the tube in the width direction, and wc is a value of X at the tube-fin contact point.)

Condition for improving thermal capacity of end portion of tube: thickness of outer wall in height direction at position of hole Referring back to FIGS. 7A and 7B, when the position X in the width direction reaches a position of the hole 122 after passing through the position of the first hole (that is, X=w0), the cross-sectional area A in the length direction is obtained by multiplying a value corresponding to two times the thickness of the outer wall in the height direction at the position of the hole 122 by the length L of the tube. When the position X in the width direction is a position of the internal wall 121, the cross-sectional area A in the length direction is obtained by multiplying the height H of the tube by the length L of the tube, that is, the cross-sectional area A in the length direction is HL.

In this case, it is preferable that the weight is biasedly distributed to the end portions of the tube in order to improve a thermal capacity of the end portion of the tube as described above. To this end, according to the present invention, a thickness of an outer wall in the height direction of each of several holes of the end portion side of the tube in the width direction is larger than that of an outer wall in the height direction of each of holes at the intermediate portion of the tube in the width direction. Hereinafter, this will be described in more detail.

First, in the tube 120, positions of the holes 122 may be expressed with the position X in the width direction as below.

First hole: $w0 \le X \le w0+h0$

Second hole: $(w0+h0)+w \le X \le (w0+h0)+(w+h)$

Third hole: $(w0+h0)+(2w+h) \le X \le (w0+h0)+2(w+h)$

Fourth hole: $(w0+h0)+(3w+2h) \le X \le (w0+h0)+3(w+h)$

*n-th* hole: $(w0+h0)+((n-1)w+(n-2)h) \le X \le (w0+h0)+(n-1)(w+h)$

In this case, a thickness of an outer wall of each of n0 holes of each of opposite end portions of the tube is larger than that of an outer wall of each of the remaining holes. When a total number of holes 122 formed in the tube 120 is N, in the case in which, for example, a thickness of an outer wall of each of only first holes and second holes from opposite end portions is larger than that of an outer wall of the remaining holes, positions of the holes 122 within such as range may be expressed with the position X in the width direction as below.

First hole: $w0 \le X \le w0+h0$

Second hole: $(w0+h0)+w \le X \le (w0+h0)+(w+h)$

*N−1-th* hole: $(w0+h0)+((N-2)w+(N-3)h) \le X \le (w0+h0)+(N-2)(w+h)$

*N-th* hole: $(w0+h0)+((N-1)w+(N-2)h) \le X \le (w0+2h0)+((N-1)w+(N-2)h)$

In the case of the N−1-th hole, N-1 may be substituted in place of n in the expression of the n-th hole. Meanwhile, similarly to the first hole, a width of the N-th hole is h0. Therefore, a lower limit value of the N-th hole may be obtained by substituting N in place of n in the expression of the n-th hole, and an upper limit value of the N-th hole may be a value of the lower limit value+h0.

The above-described example describes the expression expressing a range of positions of "first holes and second holes from the opposite end portions" with the position X in the width direction, and the expression may be generalized by substituting "the n0-th holes" in place of the second holes. In this case, n0 may be equal to or larger than 2.

A range of positions of "first holes to n0-th holes from the opposite end portions" may be expressed with the position X in the width direction as below.

First hole: $w0 \le X \le w0+h0$

Second hole: $(w0+h0)+w \le X \le (w0+h0)+(w+h)$

*n0-th* hole: $(w0+h0)+((n0-1)w+(n0-2)h) \le X \le (w0+h0)+(n0-1)(w+h)$

*N−n0+1-th* hole: $(w0+h0)+((N-n0)w+(N-n0-1)h) \le X \le (w0+h0)+(N-n0)(w+h)$

*N−1-th* hole: $(w0+h0)+((N-2)w+(N-3)h) \le X \le (w0+h0)+(N-2)(w+h)$

*N-th* hole: $(w0+h0)+((N-1)w+(N-2)h) \le X \le (w0+2h0)+((N-1)w+(N-2)h)$

This will be summarized as below.

An expression expressing a range of positions of "first holes to n0-th holes from the opposite end portions" with the position X in the width direction (hereinafter, referred to as "end portion range expression"):

First hole: $w0 \le X \le w0+h0$

*n0-th* hole: $(w0+h0)+((n0-1)w+(n0-2)h) \le X \le (w0+h0)+(n0-1)(w+h)$

*N−n0+1-th* hole: $(w0+h0)+((N-n0)w+(N-n0-1)h) \le X \le (w0+h0)+(N-n0)(w+h)$

*N-th* hole: $(w0+h0)+((N-1)w+(N-2)h) \le X \le (w0+2h0)+((N-1)w+(N-2)h)$

An expression expressing the remaining range with the position X in the width direction (hereinafter, referred to as "intermediate portion range expression"):

*n-th* hole: $(w0+h0)+((n-1)w+(n-2)h) \le X \le (w0+h0)+(n-1)(w+h), n0<n<N-n0+1$ In this case, when n0 has an excessively large value, the effect that the weight is concentrated on the end portion may rather deteriorate. Therefore, it is preferable that n0 has an appropriately small value such as 2 to 3. This may be expressed as $2 \le n0 \le 3$.

According to the present invention, t0>tm in which t0 is a thickness of the outer wall in the height direction in a range of the end portion range expression and tm is a thickness of the outer wall in the height direction in a range of the intermediate portion range expression.

Summarizing the description above, the heat exchanger 100 according to the present invention may have dimensions within a range in which the position X in the width direction and the thickness t of the outer wall in the height direction at the position of the hole 122 satisfy the following Expression so that the thickness t of the outer wall in the height direction at the position of the hole 122 in the range of the end portion range expression is larger than the thickness t of the outer wall in the height direction at the position of the hole 122 in the range of the intermediate portion range expression.

$t0>tm$ Expression 4:

(Here, t0 is a thickness of the outer wall in the height direction at a position of a hole of the end portion side of the tube in the width direction, and tm is a thickness of the outer wall in the height direction at a position of a hole of the intermediate portion side of the tube in the width direction.)

Comparison in Performance Between Related Art and Present Invention

Figure 9:
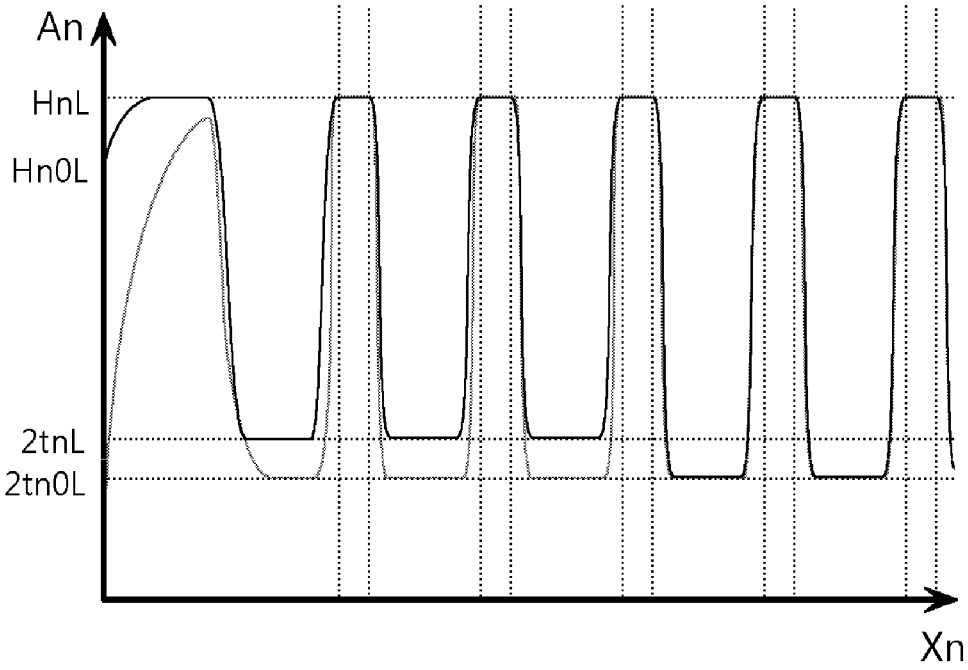
FIG. 9 is a graph for comparing a relationship between normalized positions from an end portion of the tube according to the present invention in a width direction and cross-sectional areas in a length direction at the respective positions.

FIG. 9 is a graph for comparing a relationship between normalized positions from an end portion of the extrusion tube according to the present invention in a width direction and cross-sectional areas in a length direction at the respective positions. In the normalization, X is divided by w0 at a position of an outer wall in the range of the end portion range expression, X is divided by h0 at a position of a hole in the range of the end portion range expression, X is divided by w at a position of an internal wall in the range of the intermediate portion range expression, and X is divided by h at a position of a hole in the range of the intermediate portion range expression. The comparison between the related art and the present invention is performed under the assumption that the height H of the tube according to the related art is the same as that of the tube according to the present invention above. However, such a variable may also be normalized. In this case, the variable may be normalized as a value obtained by dividing a width of the tube in the height direction by an overall height of the tube. A normalized variable as described above is marked with a subscript n. X and A also are indicated as normalized variables Xn and An, respectively.

As described above, an area of a portion under an Xn-An graph is in proportion to the weight. That is, in order to improve a thermal capacity of the end portion of the tube, the area of the portion under the Xn-An graph needs to be increased. In this case, as explicitly shown in FIG. 9, when overlapping graphs of the normalized variables described above, an area of a lower portion of an Xn-An graph at the end portion side of the tube according to the present invention is much larger than an area of a lower portion of an Xn-An graph at the end portion side of the tube according to the related art.

Summarizing the description above, the present invention has shape characteristics as below in comparison to the related art.

1) A cross section of the end portion of the tube has (unlike the semicircular shape according to the related art) a quadrangular shape of which corners are rounded (expressed by Expressions 1 to 3).

2) A thickness of the outer wall in the height direction at each of positions of two or three holes of the end portion side is larger than that of the outer wall in the height direction at each of positions of holes of the intermediate portion side (expressed by Expression 4).

As a result, in the tube 120 according to the present invention, the weight is more biasedly distributed to the end portion sides, in comparison to the case of the tube according to the related art. Therefore, a thermal capacity of the end portion side directly contacting air is further improved, thereby ultimately significantly improving heat transfer performance from the tube to the air.

The width and the height of the tube may be slightly changed from basic dimensions in order to improve heat transfer performance as described above. In practice, the basic dimensions are variously changed depending on a type of the heat exchanger (selected from an evaporator, a condenser, a radiator, a heater core, and the like), dimensions of a module in which the heat exchanger is mounted (in the case of a heat exchanger for a vehicle, a space of an engine room), required performance of the heat exchanger (in the case of a heat exchanger for a vehicle, selected from performance for a light-weight vehicle, performance for a small-size vehicle, performance for a midsize vehicle, performance for a large-size vehicle, and the like). Therefore, even when the shape characteristics as described above are complexly applied, an extent of the biased distribution of the weight to the end portions may be variously changed.

A detailed example will be described below. It is assumed that there are a tube A having a substantially large width and a tube B having a basic dimension that a width is much smaller, that is, a width of the tube B is ½ of the width of the tube A. The shape characteristics of the present invention are applied to about two to three holes of an end portion side of the tube, and the remaining portion is an intermediate portion. When simply comparing the tube A and the tube B, since the intermediate portion of the tube A is almost twice as long as the intermediate portion of the tube B, the shape according to the related art is applied to both of the end portion of the tube A and the end portion of the tube B. Alternatively, even when the shape according to the present invention is applied, an extent of biased distribution of the weight to the end portions of the tube B may be already higher than that of the tube A. In this case, even when the extent of the biased distribution of the weight is increased by applying the tube shape according to the present invention to the tube A, and the extent of the biased distribution of the weight is decreased by applying the tube shape according to the related art to the tube B, the extent of the biased distribution of the weight to the end portions of the tube B may still be higher than that of the tube A.

As such, since the basic dimensions of the tube are significantly variously changed, it is not easy to set an extent of biased distribution of a weight to end portions of any tube, in consideration of the situation described above. However, it is also true that such basic dimensions are also standardized to some degree in commercially-available tubes currently produced as tubes for a heat exchanger mounted in an air-conditioning module for a vehicle. In addition, when performing comparison in the extent of biased distribution of the weight to the end portions between the tubes having basic dimensions different from each other, a significant effect of the improved shape may not shown. However, when performing comparison in the extent of biased distribution of the weight to the end portions between the tubes having the same dimensions as each other, a significant effect of the improved shape is certainly shown according to the theoretical background as described above.

In this respect, a simulation or an experiment has been performed for the commercially-available tubes standardized to some degree, and a result thereof shows that it is preferable that 10% to 20% of a total weight of the tube 120 is biasedly distributed to a region corresponding to the following range of the position X in the width direction. Expression 5 corresponds to the above-described "end portion range expression". The expression that n0 has a value of 2 to 3 means a range of "first holes and second holes from the opposite end portions", or a range of "first holes to third holes from the opposite end portions".

First hole: $w0 \le X \le w0+h0$ $n0$-$th$ hole: $(w0+h0)+((n0-1)w+(n0-2)h) \le X \le (w0+h0)+(n0-1)(w+h)$ $N-n0+1$-$th$ hole: $(w0+h0)+((N-n0)w+(N-n0-1)h) \le X \le (w0+h0)+(N-n0)(w+h)$ $N$-$th$ hole: $(w0+h0)+((N-1)w+(N-2)h) \le X \le (w0+2h0)+((N-1)w+(N-2)h)$ $2 \le n0 \le 3$ Expression 5:

(Here, n is a hole index, N is a total number of holes, h0 is a width of a hole of the end portion of the tube in the width direction, and h is a width of a hole at the remaining positions.)

The present invention is not limited to the abovementioned exemplary embodiments, but may be variously applied. In addition, the present invention may be variously modified by those skilled in the art to which the present invention pertains without departing from the gist of the present invention claimed in the claims.

According to the present invention, it is possible to significantly improve heat transfer performance from the tube to air, in comparison to that of the related art. In more detail, according to the present invention, a contact length between the tube and the fin is maximized through optimization of a shape of the end portion of the tube. As a result, a heat transfer area is increased, thereby improving heat transfer performance from the tube to air (which is an external medium to which heat is finally transferred). In addition, according to the present invention, a thermal capacity of the end portion of the tube first contacting the air is increased by appropriately biasedly distributing a weight to the end portions of the tube, thereby further improving heat transfer performance to the air. According to the present invention, based on a synergy of the effects described above, it is possible to obtain the effect of ultimately maximizing heat transfer performance of the heat exchanger through optimization of the design of the shape and the dimension of the end portion of the tube.

Further, according to the present invention, even when an overall dimension of the heat exchanger or the heat exchanger tube is changed, a dimension for optimized heat transfer performance, pressure resistance, and manufacturability may be easily calculated. It is needless to say that convenience in design may be maximized in a process of designing a new heat exchanger or modifying the design of the existing heat exchanger.

What is claimed is:

1. A heat exchanger, comprising:

a pair of header tanks spaced apart from each other by a predetermined distance and disposed in parallel with each other;

a plurality of tubes having both ends fixed to the pair of header tanks to form channels for a refrigerant; and fins interposed between the tubes, wherein a tube of the plurality of tubes is an extrusion tube;

wherein a width W of the extension tube is larger than a height H of the extension tubed;

wherein when the channel in the extension tube is partitioned into a plurality of holes disposed in parallel with each other in a width direction of the extension tube by a plurality of internal walls extending in a height direction of the extension tube;

wherein the heat exchanger has dimensions within a range in which a position X in the width direction from an end portion of the extension tube and a cross-sectional area A of the extension tube in a length direction at the position X in the width direction satisfy the following Expressions:

$$A \le HL \text{ wherein } 0 < X \le w0 \qquad \text{Expression 1}$$

$$A \ge HL + 2rL(\sqrt{(1-(X/r-1)^2}-1)\cdot X, \text{ wherein } 0 < X \le r \text{ and } 0.15H < r < 0.45H \qquad \text{Expression 2}$$

in which;

X is a position in the width direction;

A is a cross-sectional area in the length direction;

H is a height of the extension tube;

r is a radius of a rounded corner of the tube;

L is a length of the tube;

w0 is a thickness of an outer wall in the width direction of the end portion of the extension tube in the width direction; and wc is a value of X at a tube-fin contact point; and wherein the end portion of the extension tube has a cross section in a quadrangular shape with rounded corners, each having a radius in a range of 15% to 45% of the height H of the extension tube.

2. The heat exchanger of claim 1, wherein the heat exchanger has dimensions within a range in which Expressions 1 and 2 are satisfied so that a cross section of the end portion of the extension tube has a quadrangular shape, wherein corners thereof are rounded or a larger shape than the quadrangular shape of which the corners are rounded.

3. The heat exchanger of claim 1, wherein the heat exchanger has dimensions within a range satisfying the following Expression:

$$wc \le w0 \qquad \text{Expression 3,}$$

in which wherein w0 is a thickness of the outer wall in the width direction of the end portion of the extension tube in the width direction, and we is a value of X at the tube-fin contact point.

4. The heat exchanger of claim 3, wherein the heat exchanger has dimensions within a range in which Expression 3 is satisfied so that a position where the extension tube contacts the fin is located in front of a position of a first hole of the extension tube.

5. The heat exchanger of claim 3, wherein when an expression expressing a range of positions of first holes to n0-th holes from the opposite end portions with the position X in the width direction is an end portion range expression, the end portion range expression is as follows:

$$\text{First hole: } w0 \le X \le w0 + h0$$

$$n0\text{-}th \text{ hole: } (w0+h0)+((n0-1)w+(n0-2)h) \le X \le (w0+h0)+(n0-1)(w+h)$$

$$N-n0+1\text{-}th \text{ hole: } (w0+h0)+((N-n0)w+(N-n0-1)h) \le X \le (w0+h0)+(N-n0)(w+h)$$

$$N\text{-}th \text{ hole: } (w0+h0)+((N-1)w+(N-2)h) \le X \le (w0+2h0)+((N-1)w+(N-2)h)$$

wherein n is a hole index;

N is a total number of holes; h0 is a width of a hole of the end portion of the extension tube in the width direction; and h is a width of a hole at the remaining positions.

6. The heat exchanger of claim 5, wherein when an expression expressing a range of positions of holes corresponding to the remaining region other than a region corresponding to the range of the end portion range expression with the position X in the width direction is an intermediate portion range expression, the intermediate portion range expression is as follows:

$$n\text{-}th \text{ hole: } (w0+h0)+((n-1)w+(n-2)h) \le X \le (w0+h0)+(n-1)(w+h), n0 < n < N-n0+1$$

wherein n is a hole index;

N is a total number of holes;

h0 is a width of a hole of the end portion of the extension tube in the width direction;

and h is a width of a hole at the remaining positions.

7. The heat exchanger of claim 6, wherein the heat exchanger has dimensions within a range in which the position X in the width direction and a thickness t of an outer wall in the height direction at a position of a hole satisfy the following Expression:

t=t0 (when X is within the range of the end portion range expression)

wherein t0 is a thickness of an outer wall in the height direction at a position of a hole of the end portion side of the extension tube in the width direction.

8. The heat exchanger of claim 7, wherein the heat exchanger has dimensions within a range in which the Expression is satisfied so that a thickness t of an outer wall in the height direction at a position of a hole in the range of the end portion range expression is t0.

9. The heat exchanger of claim 7, wherein the heat exchanger has dimensions within a range in which the position X in the width direction and a thickness t of an outer wall in the height direction at a position of a hole satisfy the following Expression:

t=tm (when X is within the range of the intermediate portion range expression)

Expression 4: t0 >tm in which t0 is a thickness of an outer wall in the height direction at a position of a hole of the end portion side of the extension tube in the width direction, and tm is a thickness of an outer wall in the height direction at a position of a hole of the intermediate portion side of the extension tube in the width direction.

10. The heat exchanger of claim 9, wherein the heat exchanger has dimensions within a range in which the above Expression is satisfied so that tm is a thickness t of an outer wall in the height direction at a position of a hole in the range of the intermediate portion range expression, and wherein a thickness t of an outer wall in the height direction at a position of a hole in the range of the end portion range expression is larger than a thickness t of an outer wall in the height direction at a position of a hole in the range of the intermediate portion range expression.

11. The heat exchanger of claim 5, wherein the heat exchanger has dimensions within a range satisfying the following Expression:

$$2 \leq n0 \leq$$

.

12. The heat exchanger of claim 11, wherein the heat exchanger has dimensions within a range in which the above Expression is satisfied so that the range of the end portion range expression is a range of positions of first holes to second holes or third holes from the opposite end portions.

13. The heat exchanger of claim 11, wherein 10% to 20% of a total weight of the extension tube is biasedly distributed to a region corresponding to the following range of the position X in the width direction First hole: $w0 \leq X \leq w0+h0$ $n0$-$th$ hole: $(w0+h0)+((n0-1)w+(n0-2)h) \leq X \leq (w0+h0)+(n0-1)(w+h)$ $N-n0+1$-$th$ hole: $(w0+h0)+((N-n0)w+(N-n0-1)h) \leq X \leq (w0+h0)+(N-n0)(w+h)$ $N$-$th$ hole: $(w0+h0)+((N-1)w+(N-2)h) \leq X \leq (w0+2h0)+((N-1)w+(N-2)h)$ $2 \leq n0 \leq 3$ Expression 5:

in which n is a hole index, N is a total number of holes, h0 is a width of a hole of the end portion of the extension tube in the width direction, and h is a width of a hole at the remaining positions.

14. The heat exchanger of claim 13, wherein the heat exchanger has dimensions within a range in which the above Expression is satisfied so that the weight is biasedly distributed to a region corresponding to a range of positions of first holes to second holes or third holes from the opposite end portions.

15. The heat exchanger of claim 1, wherein the extension tube is formed of an aluminum material.

* * * * *